United States Patent [19]

Sayman et al.

[11] 4,010,709

[45] Mar. 8, 1977

[54] APPARATUS FOR RANDOMLY COLORING CARPET OR OTHER PILE FABRIC

[75] Inventors: Robert W. Sayman; John S. Quarles; Howard J. Hamilton, all of Dalton, Ga.

[73] Assignee: Shaw Industries, Inc., Dalton, Ga.

[22] Filed: Jan. 28, 1976

[21] Appl. No.: 653,211

[52] U.S. Cl. ..... 118/33; 118/304; 118/325; 118/407; 68/5 D; 68/205 R; 8/1 XB; 8/14

[51] Int. Cl.[2] ..... B05C 11/00; D06B 1/04

[58] Field of Search ..... 118/33, 407, 325, 304; 68/205 R, 200, 5 D, 5 E; 28/74 R, 74 P; 8/14.1 XB

[56] References Cited

UNITED STATES PATENTS

| | | | |
|---|---|---|---|
| 139,706 | 6/1873 | Crossley | 8/1 XB |
| 1,694,466 | 12/1928 | Clavel | 8/14 |
| 3,271,102 | 9/1966 | Morgan | 68/205 R |
| 3,683,649 | 8/1972 | Takriti et al. | 68/205 R |
| 3,731,503 | 5/1973 | Appenzeller et al. | 68/205 R |
| 3,804,590 | 4/1974 | Fleissner | 68/5 E |
| 3,852,980 | 12/1974 | Zimmer | 68/5 D |
| 3,903,715 | 9/1975 | Plotz | 68/205 R |
| 3,937,044 | 2/1976 | Balmforth | 68/205 R |
| 3,941,559 | 3/1976 | Cunnane et al. | 68/5 D |

FOREIGN PATENTS OR APPLICATIONS

| | | | |
|---|---|---|---|
| 2,009,257 | 9/1971 | Germany | 8/1 XB |
| 1,941,784 | 3/1971 | Germany | 68/5 D |

*Primary Examiner*—James Kee Chi
*Attorney, Agent, or Firm*—D. Paul Weaver

[57] ABSTRACT

Following conventional pretreatment and background dyeing and washing of a carpet web, an applicator means applies a thick viscous gum coating to the pile face of the web, forming a temporary barrier thereon. Conveyor means is provided to transport the coated carpet web horizontally through a liquid dye dripping or splattering station where multiple interrupted syrupy dye streams fall on the temporary barrier and form thereon dye pools and rivulets of irregular shape, size and spacing. The conveyor means continues to transport the carpet web with the barrier coating and dye thereon horizontally into a steamer where the barrier layer dissolves and settles into the carpet pile with the dye to establish a random irregular color pattern. Fixing of the dye also takes place in the steamer. The apparatus has final washing and drying means of a conventional character beyond the steamer. Pin driving rolls for the carpet web are electrically coordinated to maintain a regulated tension on the web at all times.

11 Claims, 9 Drawing Figures

APPARATUS FOR RANDOMLY COLORING CARPET OR OTHER PILE FABRIC

BACKGROUND OF THE INVENTION

The most recent styling trends in tufted carpet involve color printing of the carpet pile on a greige background or on a single predyed background color. Silk screening techniques are commonly employed to produce a variety of repetitive printed color patterns on carpeting and other pile fabrics. Ever-changing public tastes and demands for color patterns which are away from the ordinary have led to efforts in the industry to produce unusual and varying non-repetitive random color patterns in pile carpeting by certain dye splattering techniques sometimes called tak dyeing.

Prior art machines are known for splattering dyeing of carpet pile to produce varying and non-monotonous designs in one or more colors. However, the machines and techniques employed have not been satisfactory in that the resulting splatter dyed carpet pile tends to have a spotted appearance resembling the results of spilling colored liquids, such as coffee, on a light background pile carpet. The color patterns are harsh and abruptly changing and lack a desirable soft blending of shades between the pale base color and the more concentrated randomly spaced and variously shaped color application areas.

The objective of this invention is, therefore, to overcome these defects of the prior art in terms of splatter dyeing of carpet pile by effecting some relatively minor but extremely important changes in the existing apparatus for this purpose. As a result of the apparatus changes which constitute the subject matter of this invention, certain existing prior art dyeing machines which cost several millions of dollars each, and which have been relatively useless to the industry, are now rendered extremely useful and practical in that they will unfailingly produce acceptable and highly ornate, attractive splatter dyed or randomly dyed carpet or similar pile fabric which heretofore could not be produced on a commerical basis. By means of the invention, variously and randomly colored tufted carpet patterns are made available and the color patterns are substantially endlessly variable and have the appearance qualities which the industry has been seeking in terms of soft or gentle color shade variations and the complete absence of a harsh spotted appearance.

The invention also allows many efficient components of existing machines to be employed without change with obvious economic benefit.

Other features and advantages of the invention will become apparent during the course of the following description.

SUMMARY OF THE INVENTION

In adapting an existing carpet splatter dyeing range or machine to the improved dyeing method, the splatter dye applicator is elevated so that its web engaging rolls are at the same elevation as the top rolls of a downstream horizontal run steamer. An applicator apparatus for viscous gum coating is installed upstream from the elevated splatter dye applicator and at the same elevation as the web transport rolls of the latter. Intervening idler rolls for the support of the carpet web in a horizontal plane are installed between the steamer and splatter dye applicator and between the dye and viscous gum applicators. Hence, the carpet web during its entire treatment under the present invention is transported horizontally and this is critical to the success of the invention and not attainable in the prior art. To assure proper tensioning and feeding of the web in the modified apparatus, a previously employed web compensating loop control is eliminated and instead thereof a regenerative electric motor control system is utilized to regulate the main web drive roll at the dye applicator station and coordinate the speed of a downstream web drive roll in the steamer with the main drive roll.

BRIEF DESCRIPTION OF DRAWING FIGURES

DETAILED DESCRIPTION

Figure 1:
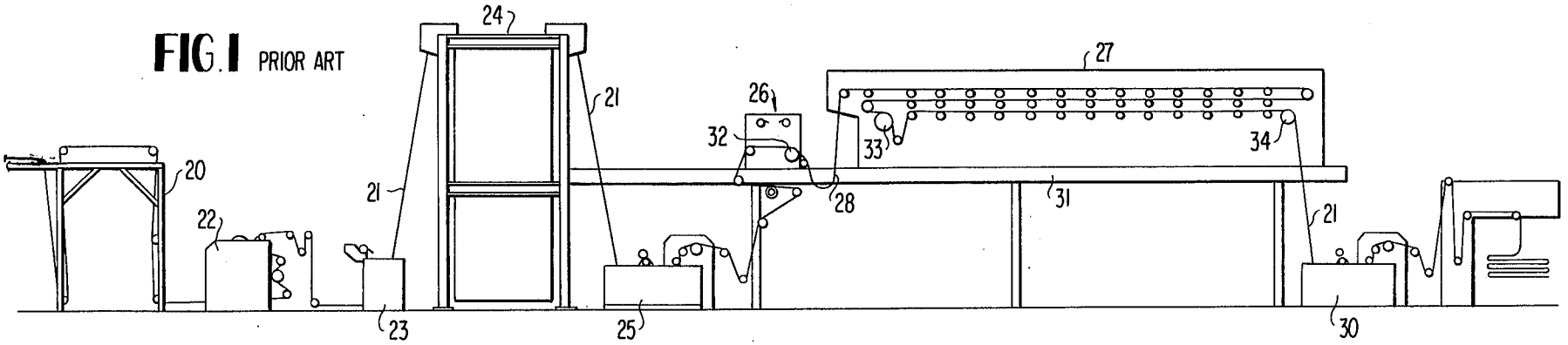
FIG. 1 PRIOR ART
FIG. 1 is a schematic side elevational view of a prior art carpet dyeing apparatus or range which has been modified in the present invention.
Figure 2:
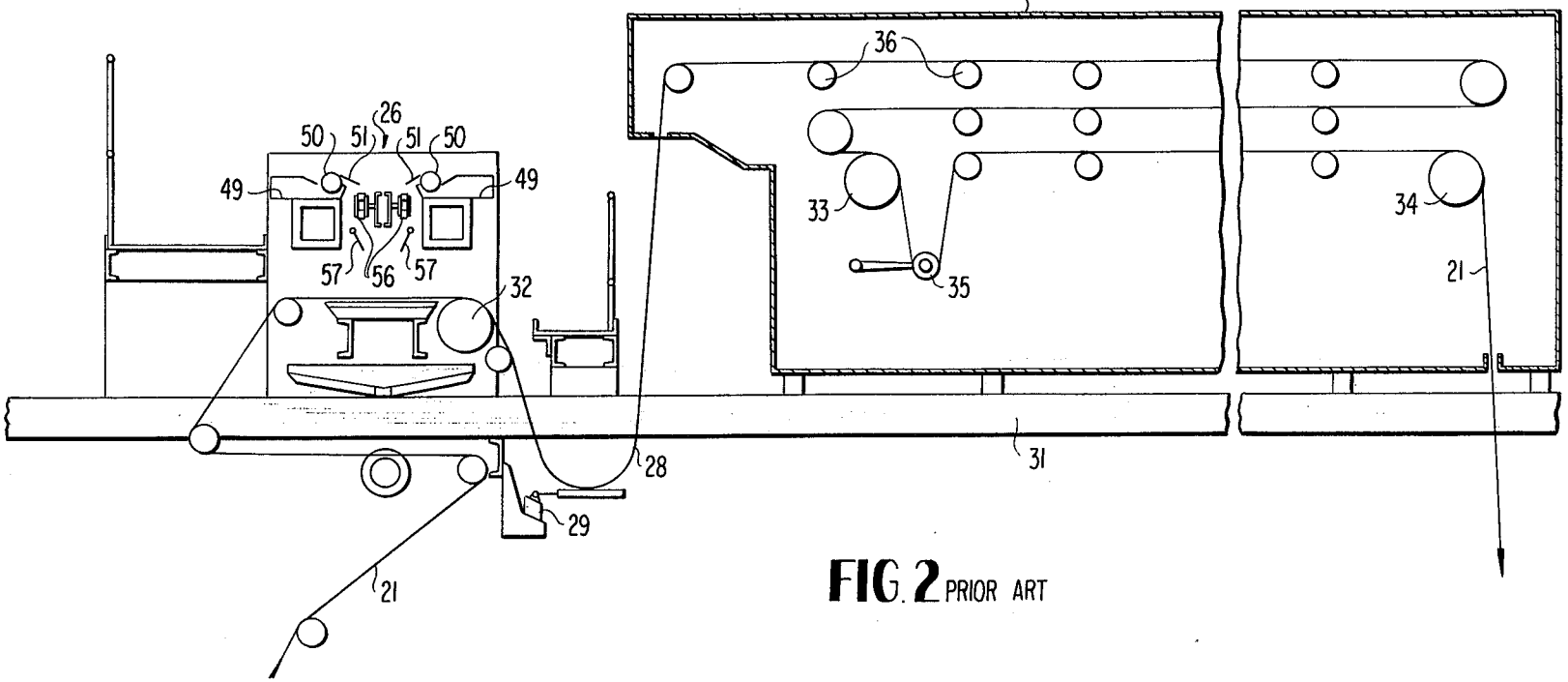
FIG. 2 PRIOR ART
FIG. 2 is a further schematic side elevational view of the prior art apparatus on an enlarged scale and showing the main components which are modified by the invention.
Figure 3:
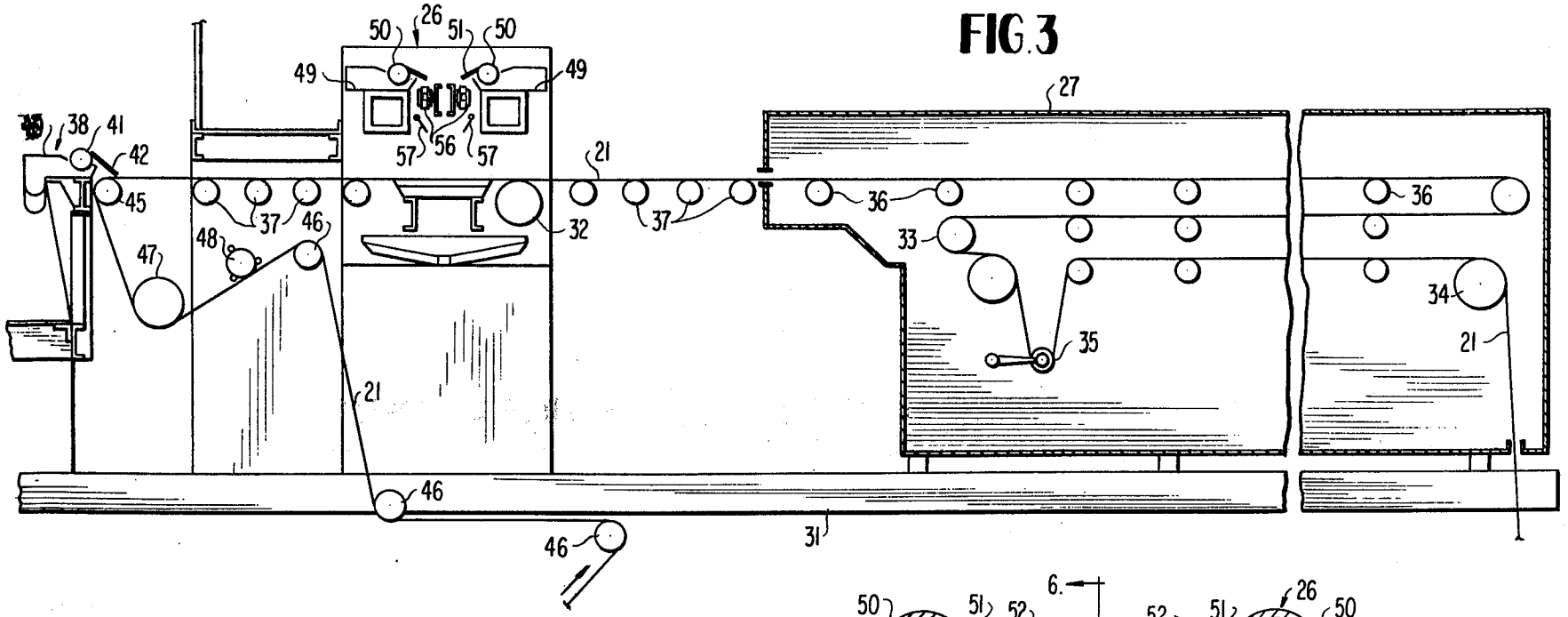
FIG. 3 is a side elevational view, similar to FIG. 2, and depicting the apparatus modifications embodied in the present invention.

Referring to the drawings in detail wherein like numerals designate like parts and initially considering FIGS. 1 and 2 showing the prior art, a complete carpet dyeing range or apparatus is illustrated in FIG. 1 including conventional guiding and infeed means 20 for a tufted carpet web 21 or like pile fabric, a conventional prescouring unit 22, and a dyeing unit 23 where a single background color is imparted to the carpet pile prior to giving it a variable color pattern at a downstream splatter dyeing station, to be described. Upon leaving the dyeing unit 23, the background color dye is fixed in the carpet pile during passage of the web 20 through a conventional vertical steamer 24 which accommodates several vertical loops of the carpet web internally. From this steamer, the web 21 advances into a wash box 25 and then through a system of guide rolls upwardly to a splatter dye applicator unit 26 which is shown in greater detail in FIGS. 2, 5 and 6 and will be further described. In the prior art apparatus, the carpet web 21 upon leaving the dye applicator 26 and before entering a horizontal steamer 27 at a higher elevation develops a slack loop or a compensating loop 28 whose size is regulated by a conventional control means 29 shown in enlarged FIG. 2. From this loop, the carpet web ascends substantially vertically into the top of horizontal steamer 27, through which it passes in several horizontal runs, as shown, and the dye applied by the unit 26 becomes fixed in the steamer. After emergence from the steamer 27, the carpet enters another wash box 30 and travels onward to a conventional drying station, not shown. The prior art apparatus has an elevated support 31 for steamer 27 and splatter dye applicator 26, as shown.

Referring primarily to FIG. 2, the carpet web 21 is advanced by a main powered pin roll 32 at the applicator 26, there being a secondary driven pin roll 33 within the steamer 27 engaging the carpet web and a final drive roll 34 near the exit of the steamer. A compensating roll 35 within the steamer maintains the proper tension on the carpet web and also regulates the speed of drive roll 34 in a conventional way known in the art.

Reference is now made to FIGS. 3 through 9 depicting the invention. In these figures, the splatter dye applicator 26 remains essentially unchanged in its construction and operation but has been elevated from the support 31 so that the main carpet web drive roll 32 has its top at the same elevation as the tops of the upper row of web-supporting idler rolls 36 within the steamer 27. The steamer remains essentially unchanged from the prior art. Upstream and downstream from the dye applicator 26 additional web supporting idler rolls 37 are installed so that the carpet web may be supported and advanced horizontally during the improved method of dye application, which method forms the subject matter of copending application Ser. No. 653,191, filed Jan. 28, 1976, for METHOD OF COLORING CARPET OR OTHER PILE FABRIC, filed on even date herewith. It is essential and quite critical that the carpet web move in a horizontal plane between the gum shield applicator, yet to be described, and the upper run of the web within the steamer 27 so that neither the viscous coating forming the temporary shield nor the liquid dye applied by the applicator 26 will run.

Upstream from the dye applicator 26, an applicator means 38 for an inert viscous natural gum coating 39 is provided. This applicator means includes a trough 40 for the coating which is maintained at a constant level therein from an overhead gravity source, not shown. A pick-up roll 41 takes the coating 39 from the trough 40 and delivers it to a doctor blade 42 from which the coating is delivered as an approximately ⅛ inch thick temporary shield or barrier layer 43 on the pile face 44 of carpet web 21, FIG. 7. A leveling roll 45 adjacent the applicator 38 is at the same elevation as the support rolls 37 and the rolls 32 and 36 so that horizontal travel for the carpet web is assured at all points between the coating applicator 38 and the steamer 27.

Ahead of the applicator 38, the carpet web ascends from the wash box 25, FIG. 1, and during this movement is guided by a series of idler rolls 46 before engagement with a powered pin roll 47 ahead of the leveling roll 45. Preferably a back beater roll or device 48 is provided in the modified apparatus for the purpose of loosening and straightening the carpet pile 44 prior to the application of the viscous coating 39.

Figure 5:
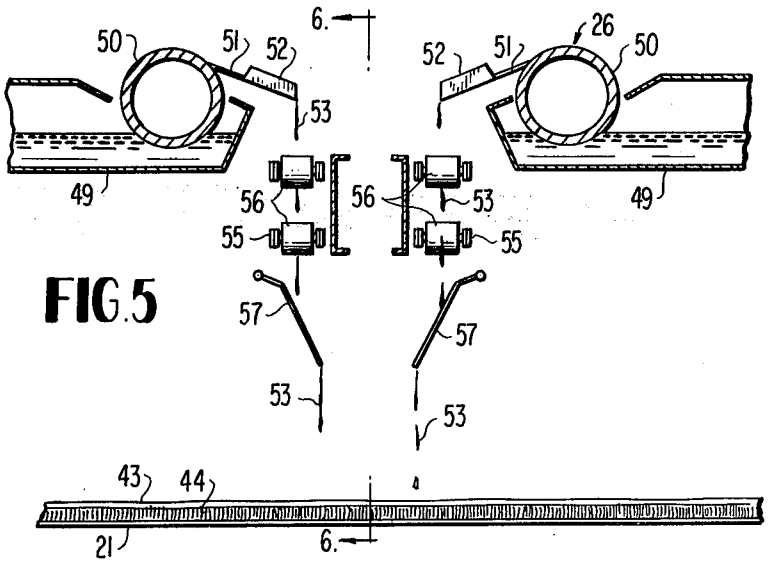
FIG. 5 is a similar cross sectional view on an enlarged scale of the splatter dye applicator.
Figure 4:
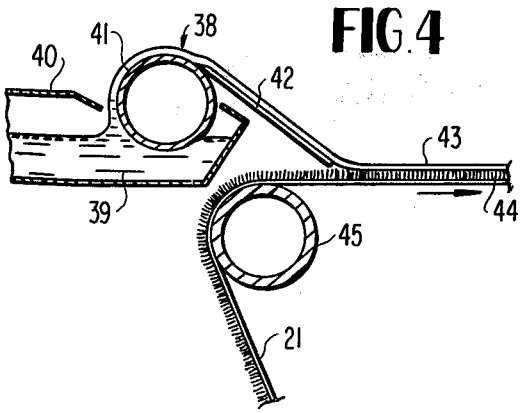
FIG. 4 is an enlarged fragmentary vertical section taken through a viscous gum coating unit employed in the invention upstream from the splatter dye applicator.
Figure 6:
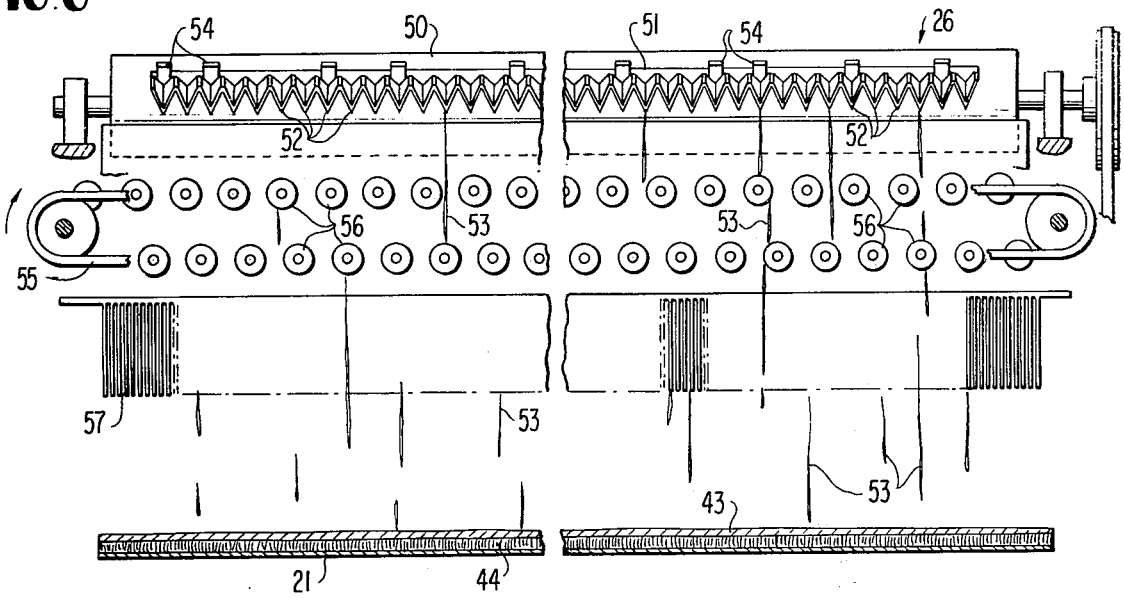
FIG. 6 is a transverse vertical section taken on line 6—6 of FIG. 5.
Figure 7:
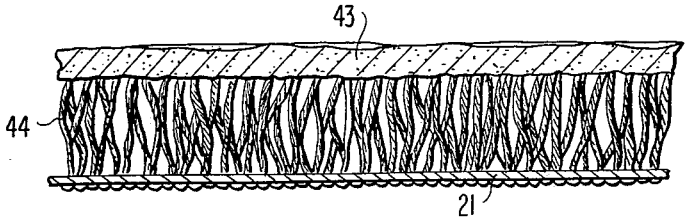
FIG. 7 is an enlarged fragmentary cross sectional view taken through the carpet web with the viscous coating forming a temporary dye barrier layer thereon.
Figure 8:
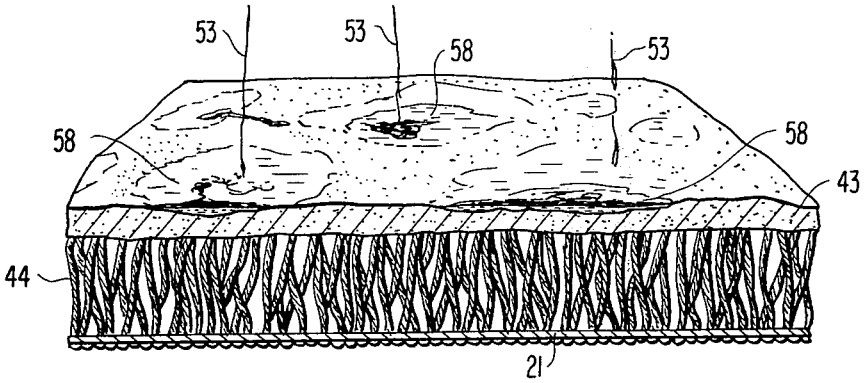
FIG. 8 is a perspective view in cross section depicting the application of dye drippings or splattering onto the barrier layer while the carpet web is being transported horizontally.
Figure 9:
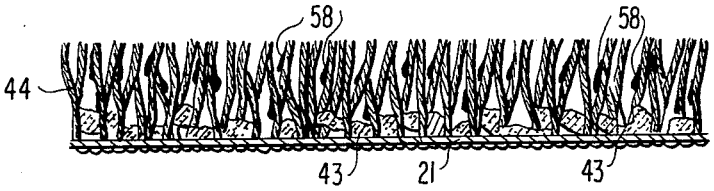
FIG. 9 is a fragmentary cross sectional view taken through the carpet web illustrating the disintegration of the temporary barrier layer and the settling of the dye into the carpet pile for establishing a color pattern thereon.

The splatter dye applicator 26 which is per se conventional comprises a pair of opposed identical applicator units, FIG. 5, so that two different dye colors may be applied to the carpet or, in some cases, two applications of a single dye color. Each applicator unit embodies a dye trough 49 for a liquid dye or dyes of a syrupy consistency and a viscosity which is much less than that of the thick gum coating 39, the latter usually having a viscosity of approximately 3000 c.p.s. The dye formulation is conventional and is chosen from a number of available dyes so as to be compatible with various synthetic or natural fibers or mixtures of such fibers in the pile yarns. Each applicator unit of the applicator assembly 26 further has a dye pick-up roll 50 for delivering a uniform film of liquid dye to a coacting doctor blade 51, each having a multiplicity of inclined V cross section gutter extensions 52 by means of which the liquid dye is divided into multiple separate streams or drippings 53. Some or all of the gutter extensions 52 may be equipped with flow control plugs 54 whereby the flow from certain gutters may be regulated or stopped completely in the interest of varying the random color pattern for the carpet.

Below the opposing sets of gutter extensions 52, a power driven endless flexible conveyor element 55, such as a sprocket chain, carries plural evenly spaced cylindrical horizontal axis stream cutters or interruptors 56 which travel continuously beneath the outlets of the gutter extensions 52 in two horizontal passes moving in opposite directions, transversely of the line of movement of the carpet web 21. The moving elements 56 constantly travel through the falling dye streams 53 and cut or interrupt the same so that the drip pattern of the liquid dye is completely random, irregular and widespread across the pile face 44 of the horizontally moving carpet web. The thick viscous shield 43 also covers completely the carpet pile face 44 and the dye streams or drippings 53 fall on the shield 43 which offers a temporary barrier preventing the dye from penetrating into the pile 44 prior to entry of the web into the steamer 27.

Below the stream interruptors 56, stationary inclined combs 57 further intercept and break up the falling dye streams 53, again for the purpose of rendering the drip or splatter dye pattern completely random, non-uniform and non-repetitive on the carpet pile face. If desired, the comb elements 57 which are pivotally mounted can be flipped outwardly from their active positions of FIG. 5 to inactive positions clear of the falling dye streams.

While a preferred type of dye applicator 26 has been disclosed, other known types of splatter or random drip applicators could be employed instead of the described applicator 26 in an overhead position above the horizontally transported carpet web.

As fully described in the above-noted copending patent application, the syrupy dye drippings or streams 53 fall upon the resist layer or temporary barrier layer 43 of relatively high viscosity. On this barrier layer, the liquid dye pools or puddles randomly and in various configurations including irregular rivulets of dye so as to collectively form a random dye pattern. Following entry of the web 21 horizontally into the hot environment of the steamer 27, the viscous barrier layer 43, dissolves, melts or disintegrates and with the pools and rivulets 58 of liquid dye thereon settles into the carpet pile 44, depositing the dye into the pile fibers by penetration and absorption. The dye also becomes fixed within the elevated temperature chamber of the steamer 27. The final color pattern on the carpet pile is established by the variegated configurations of the liquid dye pools and rivulets 58 at the moment of disintegration of the barrier layer 43 and its descent with the dye into the carpet pile.

Upon exiting from the steamer 27, the dyed carpet web enters the conventional wash box 30 and is subsequently extracted and dried conventionally.

Because of the elimination of the carpet slack loop 28 and loop control means 29 of the prior art, the carpet web drive is modified under the invention. In place of the control means 29, a preferably five horsepower regenerative type drive is installed on the DC motor, not shown, of the main pin drive roll 32 of the system. A potentiometer control is installed on the DC motor of the downstream drive roll 33 in the steamer 27 to provide for varying the tension of the web between the two drive rolls 32 and 33. Basically, the system of motor control serves the same purpose as the prior art compensating loop control means 29. The motor control system of the invention is per se conventional and many satisfactory electrical motor control devices are known to satisfy the needs of the invention. Therefore, it is thought to be unnecessary to describe in further detail the drive motor control means for a proper understanding of the present invention. Suffice it to say that all of the carpet web active or driving rolls follow the speed of the main drive roll 32, which speed is preset. The desired web tension is established through the potentiometer means of the drive roll 33. As this drive roll 33 tends to lag or lead the main drive roll 32, the well known regenerative power control device for the roll 32 senses any change and feeds the appropriate current to the DC motor to maintain a proper driving speed. The compensating roll 35 maintains the proper tension in the carpet web between the rolls 33 and 34 and the compensating roll functions the same as in the prior art.

It is to be understood that the form of the invention herewith shown and described is to be taken as a preferred example of the same, and that various changes in the shape, size and arrangement of parts may be resorted to, without departing from the spirit of the invention or scope of the subjoined claims.

We claim:

1. An apparatus for randomly coloring a pile carpet web or the like comprising means for supporting and conveying a carpet web on a substantially horizontal path of movement with the pile face of the carpet web upwardly, means substantially aligned horizontally with said supporting and conveying means and near the upstream end of the horizontal path of movement of the carpet web for applying a relatively thick viscous coating layer to the pile face of the carpet web during movement thereof, means downstream from the applicator means for said viscous coating for delivering liquid dye drippings randomly on top of said viscous coating layer from an overhead dye source whereby said dye drippings may pool and run in irregular rivulets on said viscous coating layer without immediately penetrating into the carpet pile face, and elevated temperature means downstream from said dye delivery means and being substantially aligned horizontally with said supporting and conveying means and receiving the moving carpet web with the viscous coating layer and the dye drippings thereon and causing the viscous coating layer to disintegrate and settle into the carpet pile face with said dye drippings to thereby form a permanent random color pattern in the carpet pile face and to fix the dye.

2. The apparatus of claim 1, and said means for supporting and conveying said carpet web comprising a substantially horizontal roller bed including web support rollers arranged upstream and downstream from said dye delivery means and between the latter and the applicator means for the thick viscous coating and the elevated temperature means.

3. The apparatus of claim 2, and at least one roller in said roller bed being a power drive roller for the carpet web.

4. The apparatus of claim 1, and said means for applying said thick viscous coating layer comprising a coating trough, a coating material pick-up roll projecting into said trough, a doctor blade adjacent the pick-up roll for removing a layer of coating material therefrom and delivering it onto said pile face of the moving carpet web, and a web leveling roll near and below said doctor blade directing said web into a horizontal path of movement downstream from said doctor blade.

5. The apparatus of claim 1, and said means for delivering liquid dye drippings randomly onto said coating layer comprising a splatter dye applicator disposed above the level of the moving carpet web.

6. The apparatus of claim 5, and said splatter dye applicator means including a pair of opposing duplicate units whereby two differently colored dyes or dual applications of a single color dye may be delivered onto said coating layer.

7. The apparatus of claim 6, and each applicator unit comprising a dye trough, a dye pick-up roll therein, a doctor blade to strip dye from the applicator roll, multiple dye stream forming gutter extensions on each doctor blade, moving dye stream interruptor elements below said gutter extensions, and dye stream interrupting comb elements below said interruptor elements.

8. The apparatus of claim 1, and said elevated temperature means comprising a steamer unit having plural horizontal rows of carpet web engaging rolls therein and with the top row of said rolls disposed at the same elevation with said means to support and convey a carpet web.

9. The apparatus of claim 8, and a primary powered carpet web driving roll adjacent the means for delivering liquid dye drippings randomly, and at least one secondary powered carpet web driving roll adjacent said steamer unit having its rotational speed coordinated with the speed of the primary powered roll, whereby the carpet web is maintained under a substantially constant temperature while moving through the apparatus.

10. The apparatus of claim 1, and additional means upstream from said means to apply said thick viscous coating layer for background dyeing the carpet pile and for washing the web following said background dyeing prior to the delivery of the web to said means for applying said thick viscous coating layer.

11. The apparatus of claim 10, and additional means downstream from said elevated temperature means for washing the pile carpet web to remove therefrom excess dye and the remains of the disintegrated viscous coating layer.

* * * * *

UNITED STATES PATENT OFFICE
CERTIFICATE OF CORRECTION

PATENT NO. : 4,010,709

DATED : March 8, 1977

INVENTOR(S) : Robert W. Sayman et al

It is certified that error appears in the above-identified patent and that said Letters Patent are hereby corrected as shown below:

Column 1, line 17, change "splattering" to --splatter--.

Column 4, line 60, after "43" delete ",".

Column 6, line 28, after "duplicate" insert --applicator--.

Signed and Sealed this Seventh Day of June 1977

[SEAL]

*Attest:*

RUTH C. MASON
*Attesting Officer*

C. MARSHALL DANN
*Commissioner of Patents and Trademarks*